US006166708A

United States Patent [19]

Maury

[11] Patent Number: 6,166,708

[45] Date of Patent: Dec. 26, 2000

[54] APPARATUS PERFECTED ARRANGEMENT OF SPIRAL ANTENNAS

[75] Inventor: Laurent Maury, Saint-Cloud, France

[73] Assignee: Dassault Electronique, Saint-Cloud, France

[21] Appl. No.: 08/999,827

[22] Filed: Sep. 3, 1992

Related U.S. Application Data

[63] Continuation of application No. 07/585,204, Aug. 29, 1990, abandoned.

[51] Int. Cl.[7] ..... H01Q 1/36

[52] U.S. Cl. ..... 343/895

[58] Field of Search ..... 343/895

[56] References Cited

U.S. PATENT DOCUMENTS 2,977,594 3/1961 Marston et al. ..... 343/895

3,787,871 1/1974 Reese ..... 343/895

4,087,821 5/1978 Phelan ..... 343/895

*Primary Examiner*—Theodore M. Blum

*Attorney, Agent, or Firm*—Brown & Wood, LLP

[57] ABSTRACT

The antenna device comprises, on a substrate, a plurality of radiating elements and a pair of terminals for the supply of high-frequency electrical signals for each one of these elements. Each one of these radiating elements comprises a zone of spiral configuration (SPi), and possesses an extension (PB1i, PB2i) of the strands of its spiral having geometric characteristics different from those of said spiral, to form, for example, a peripheral ring (CP) surrounding the latter.

12 Claims, 1 Drawing Sheet

APPARATUS PERFECTED ARRANGEMENT OF SPIRAL ANTENNAS

This is a continuation of application Ser. No. 07/585,204 filed Aug. 29, 1990, abandoned.

The Invention Relates to Spiral Antennas

A spiral antenna comprises, on a support, two strands of identical length which are wound so as to be adjacent, to form together a spiral, the value of the lower operating frequency of which is linked, to a first approximation, to that of its external diameter.

If it is desired to restrict the radiation to the portion of space situated facing the spiral, it is possible to place the other face of the support in contact with a cavity filled with an electromagnetically absorbing material. When correctly fed with high-frequency electrical signals, an antenna of this type radiates into the desired portion of space, in a very broad frequency band.

Consideration has been given to the idea of arranging such antennas in an array. However, as will be seen in greater detail hereinbelow, such a configuration raises operational problems linked, in particular, to the properties of arrays, especially when operation in a very broad frequency band is under consideration.

The invention aims to provide a solution to this problem.

An object of the invention is to provide a device comprising a plurality of spiral antennas arranged in an array, capable of operating in a very broad frequency band without operational impairment linked to the array structure.

According to a general feature of the invention, the proposed antenna device comprises, on a substrate, at least two radiating elements and a pair of terminals for the supply of high-frequency electrical signals for each one of these elements; each one of these comprises a zone of spiral configuration, and at least one of these possesses an extension of the strands of its spiral having geometric characteristics different from those of said spiral.

Figure 1:
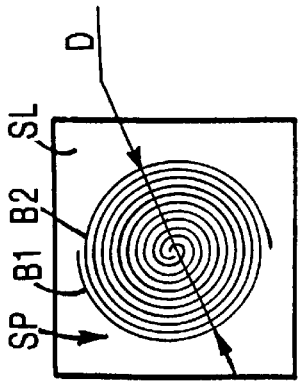
Figure 2:
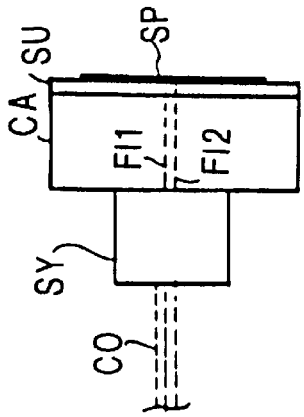
Figure 3:
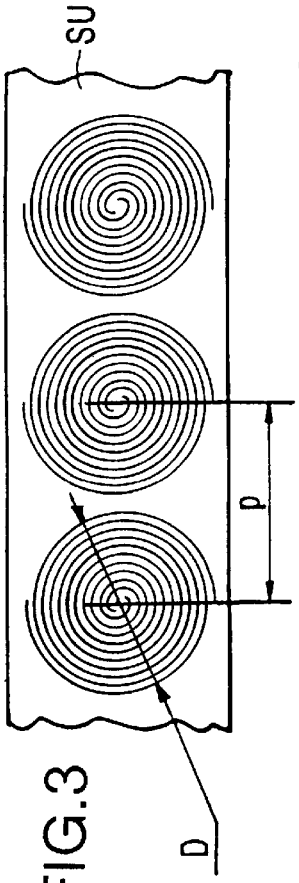
Figure 4:
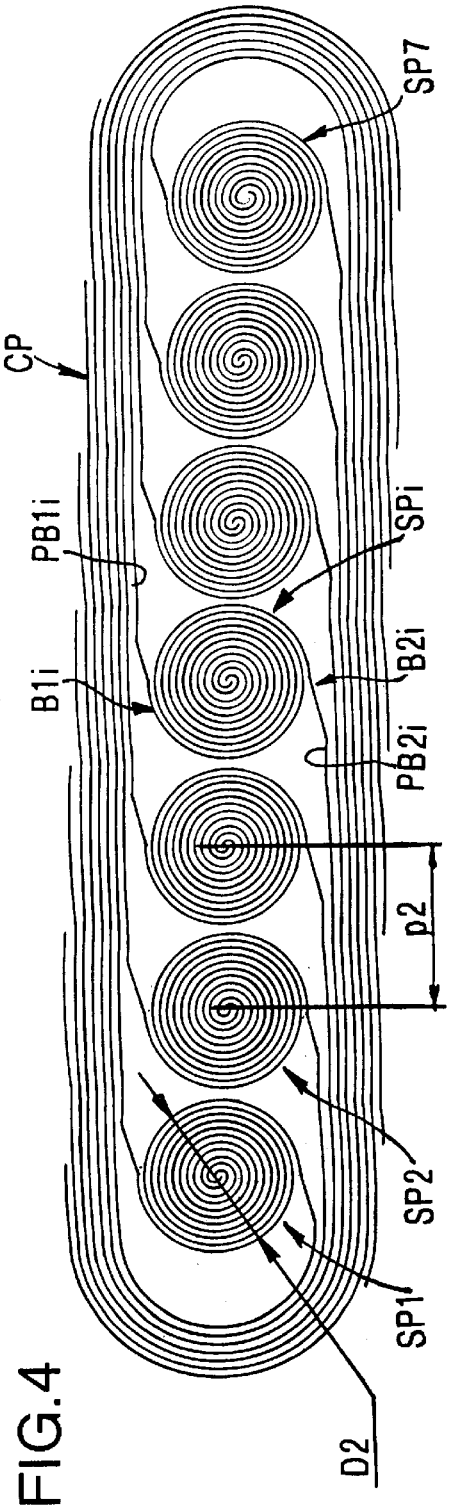

Further advantages and features of the invention will become evident on examining the detailed description given hereinbelow and the accompanying drawings, in which:

FIGS. 1 and 2 illustrate very diagrammatically an isolated conventional spiral antenna, FIG. 3 diagrammatically illustrates three spiral antennas arranged in accordance with a configuration exhibiting operational problems, and FIG. 4 is a partial diagrammatic illustration of an embodiment of a device according to the invention.

The drawings essentially include elements of a definite nature. On this basis, they form an integral part of the description and will be able not only to serve to provide a better understanding of the detailed description given hereinbelow, but also to contribute, as appropriate, to the definition of the invention.

As diagrammatically illustrated in FIGS. 1 and 2, a printed spiral antenna comprises, on one face of a support (for example a dielectric) SU, two metal strands B1 and B2, of identical length, which are wound in relation to one another so as to be adjacent, to form a spiral SP. In other words, with the exception of the vicinity of the strand ends, each strand portion is framed by two portions of the other strand.

It should be noted that what is illustrated here is a spiral referred to as "Archimedian", that is to say a spiral in which each strand has a constant thickness and a constant spacing relative to the other strand. However, consideration may be given to other types of spirals, such as spirals referred to as "logarithmic", in which a rate of expansion is provided for the widths of the strands, as well as an increasing spacing between the latter. Within the meaning of the present description, the expressions "spirals" or "spiral antennas" must be interpreted in a very broad sense covering all types of spirals.

Such an antenna is capable of operating in a very broad frequency band, such that the ratio of the upper frequency to the lower frequency is, for example, of the order of four. Its lower operating frequency F1 is then given, to a first approximation, by the following formula:

$$pi.D=c/F1=\text{lambdal}$$

in which pi designates the real number substantially equal to 3.14,

D designates the external diameter of the spiral SP, c designates the speed of light, F1 designates the lower operating frequency, and lambdal designates the wavelength associated with the frequency F1.

A spiral antenna also exhibits the particular feature of radiating not only into the portion of space situated facing the spiral SP but also into the portion of space facing the other face, or rear face, of the support SU. Further, if it is desired to restrict this radiation to the portion of space situated facing the front face of the support, it is possible to arrange the other face of the latter in contact with a cavity CA filled with a material absorbing the high-frequency electromagnetic waves in a broad band.

The feeding of the two strands of such an antenna is undertaken by two wires FI1 and FI2 which are connected to both respective ends of the two strands which are situated at the centre of the spiral. The feeding with high-frequency electrical signals is undertaken generally by means of a coaxial cable CO, which is by nature asymmetric, since it comprises a central core and a sheath. Good operation of a spiral antenna requires, by reason of its symmetrical geometric characteristics, a feeding with electrical signals of "symmetric" type, that is to say which is identical for the two strands. Accordingly, it is necessary to provide, to the rear of the cavity CA, a symmetry-creating electronic element SY providing this symmetry-creating function. It should be noted at this point that the two wires FI1 and FI2, passing through the cavity of absorbing material CA, do not disturb the radiation of the antenna, since the latter is inhibited in the rear portion of space.

In order, in particular, to have the benefit of the very-broad-band operating properties of spiral antennas, consideration has been given to the idea of arranging these in an array. One solution might consist in arranging these spirals side by side as very diagrammatically illustrated in FIG. 3. However such a solution is not satisfactory, for the reasons which are now set forth.

It is, in fact, known that the correct operation of an array at a given frequency is greatly dependent upon the spacing pitch of the antenna elements making up this array. Thus, for a wavelength lambda, corresponding to a given operating frequency, it is necessary for the pitch p of the array to be less than or equal to one half of the value of this wavelength. In fact, if the pitch p exceeds one half of this value, the radiation pattern of the array may exhibit a parasitic lobe, or "array lobe", which is offset in relation to the useful main lobe of this array and which disturbs the operation of the latter.

The pitch p of such an array is a minimum when the spirals are close to one another so that their respective external diameter D is substantially equal to the pitch p. At the low operating frequency F1 corresponding to the wavelength lambdal, the pitch p, which is moreover equal to the diameter D, then adopts by application of the formula set forth hereinabove, the value (lambdal/pi). In these circumstances, at this frequency there is no operating problem, since the pitch p is less than (lambdal/2).

However, if it is desired to operate this array in a very broad frequency band extending up to a high operating frequency F2 equal for example to four times the low operating frequency F1, it is appreciated that the pitch p is then equal to the product of the wavelength lambda2, corresponding to the frequency F2, by a factor equal to 4/pi. The operation of the array is thus impaired at the frequency F2 by the presence of an array lobe, since the pitch p is greater than lambda2 and thus, a fortiori, than (lambda2/2).

The invention succeeds in providing a solution to this problem.

The Applicant has, in fact, observed that in an antenna device comprising a plurality of radiating elements (at least two) each having a zone in a spiral configuration, it was appropriate for at least one of them to possess an extension of the strands of its spiral having geometric characteristics different from those of said spiral.

Proceeding from this very general observation, the Applicant implemented the invention in a particular embodiment illustrated in FIG. 4.

For purposes of simplification, this figure shows only the geometric configurations of the strands of the various spirals, a pair of terminals for the supply of high-frequency electrical signals being, of course, provided for each one of the radiating elements of this array.

As this array has to operate from a low frequency F1, the length of the two strands of each radiating element of the array, which length is identical for all the radiating elements, is determined in order that a spiral antenna element formed by these two strands should have an external diameter D permitting operation at this low frequency F1.

As the array has to operate in a very broad frequency band up to a high frequency F2 for example equal to four times the low frequency, an array pitch p2 is selected which is generally less than, and preferably equal to one half of the value of the wavelength lambda2. The two strands of each radiating element of the array are then wound so as to be adjacent to form a zone in a spiral configuration, having an external diameter D2 which is substantially equal to the pitch p2. All these zones in spiral configurations SP1–SP7 are then aligned side by side on the substrate in such a manner as to form a row.

The excess length of the strands B1i and B2i of a radiating element is then arranged on the free surface of the substrate and forms an extension PB1i and PB2i having geometric characteristics different from those of the corresponding spiral SPi.

Thus, in this example, the two strands PB1i and PB2i of the extension of the spiral SPi leave the latter at diametrically opposite points and run around all the zones SP1–SP7 of the radiating elements in the same direction as that of the spirals. In other words, all the strands of all the extensions run so as to be adjacent to one another, to form a peripheral ring completely surrounding the spirals SP1–SP7.

In these circumstances, such an array operates correctly at the high frequency F2, since the pitch has been determined appropriately. It likewise operates correctly at all the other frequencies as far as the low frequency F1, since the pitch p2, calculated for the high frequency F2, is necessarily less than one half of the value of the wavelength lambdal corresponding to this low operating frequency.

It should also be stated that the contribution of the radiation of this antenna device is principally supplied by the spirals SPi as regards the high operating frequency, while the peripheral ring CP makes the principal contribution in the case of the low operating frequency.

However, it may be advantageous for the lines of this peripheral ring CP to be partially or entirely covered with a material incorporating microwave losses, such as the materials loaded with ferrite. In this case, the lines of this ring do not participate directly in the radiation at the bottom of the band, since they damp the electromagnetic wave throughout the length of its travel on these lines. On the other hand, these lines then permit a significant improvement in the performance levels at the bottom of the band, by very greatly avoiding the return propagation of the electromagnetic wave in the spiral, such propagation being caused by the reflection of the electromagnetic wave at the end of the strand.

It is, of course, possible to control this radiation at the bottom of the band by an appropriate location of the material incorporating loss, it being stated that, in any event, this low-frequency radiation is likewise produced to a small extent at the location of the spirals SP1, this taking place virtually without any disturbance.

The invention is not limited to the embodiment described hereinabove, but covers all the variants thereof contained within the scope of the claims hereinafter appearing.

Thus, the extension of the strands of the spirals may be situated in the plane of the latter or alternatively outside this plane. Likewise, in either or both of these cases this extension may run or not run around said spirals.

A description has been given hereinbefore of spirals all having the same angular configuration in their plane. A person skilled in the art is aware that it is possible to vary the phase of a spiral antenna by changing this angular configuration. Such a consideration may be applied to the present invention.

Some of the means described hereinabove may, of course, be omitted in the variants in which they are not used.

What is claimed is:

1. Antenna device, comprising:

a support, at least two radiating elements located on said support, each of said at least two radiating elements having one pair of strands, each of said pairs of strands defining a central zone in the form of a spiral with the central zones being co-planar, and at least one of said pairs of strands further defining an extension zone located outwardly from and connected to said central zone, said extension zone being co-planar with said central zones, said strands in said extension zone arranged in a form different from a spiral, and at least two terminals located on said support and adapted respectively to feed said at least two radiating elements with high-frequency electrical signals.

2. Antenna device according to claim 1, adapted to operate between a low operating frequency and a high operating frequency, wherein all said central zones are mutually spaced apart with a spacing pitch not greater than equal to one half of the wavelength corresponding to said high operating frequency.

3. Antenna device according to claim 1, wherein all said central zones are in the form of a spiral having substantially the same external diameter.

4. Antenna device according to claim 3, wherein all said central zones are mutually spaced with a spacing pitch substantially equal to said same external diameter.

5. Antenna device according to claim 1, wherein portions of the two strands located in said extension zone laterally enclose all said central zones and extend in the same direction as that of said spirals, said extension zone being in the form of a closed ring.

6. Antenna device according to claim 1, wherein portions of the two strands in said extension zone extend from the corresponding spiral respectively at two diametrically opposite points of said corresponding spiral.

7. Antenna device according to claim 1, wherein each of said pairs of strands further defines the extension zone in the form different from a spiral.

8. Antenna device according to claim 7, wherein each respective portion of the strands in said extension zone extend in the same direction as that of said spirals and adjacent to one another to form a closed ring completely surrounding all said spirals.

9. Antenna device according to claim 1, wherein a plurality of said radiating elements are arranged spaced apart side-by-side in a row.

10. Antenna device according to claim 9, wherein all the spirals of said radiating elements in said row have the same angular configuration.

11. Antenna device according to claim 7, wherein said antenna device is adapted to operate between a low operating frequency and a high operating frequency, and the strands of the radiating elements have substantially the same length, said length being determined as a function of said low operating frequency.

12. Antenna device according to claim 1, wherein at least one said radiating element further comprises a material incorporating microwave losses covering at least partially the portion of the strands of the corresponding extension zone of said at least one radiating element.

* * * * *